US006564426B1

(12) United States Patent
Wang

(10) Patent No.: US 6,564,426 B1
(45) Date of Patent: May 20, 2003

(54) RETRACTABLE HANDLE ASSEMBLY HAVING ROTATABLE HAND GRIP

(76) Inventor: Gin Chiao Wang, No. 5, Gong Yeh Chu 10th Road, Da Gia Town, Taichung Hsien (TW), 437

( * ) Notice: Subject to any disclaimer, the term of this patent is extended or adjusted under 35 U.S.C. 154(b) by 0 days.

(21) Appl. No.: 10/078,517

(22) Filed: Feb. 21, 2002

(51) Int. Cl.[7] ..... E05B 7/00

(52) U.S. Cl. ..... 16/113.1; 16/405; 16/429; 16/114.1; 16/430; 16/411

(58) Field of Search ..... 16/113.1, 114.1, 16/405, 408, 411, 429, 430, 111.1, 110.1

(56) References Cited

U.S. PATENT DOCUMENTS 5,351,984 A 10/1994 Cheng ..... 280/655
5,669,103 A * 9/1997 Hui ..... 16/113.1
5,813,504 A * 9/1998 Iny et al. ..... 190/116
6,009,598 A * 1/2000 Chang ..... 16/113.1
6,061,871 A * 5/2000 Wang ..... 16/113.1
6,148,477 A * 11/2000 Cheng ..... 16/113.1
6,202,254 B1 * 3/2001 Ezer ..... 16/113.1
6,317,924 B1 * 11/2001 Gallagher ..... 16/114.1
6,357,567 B1 * 3/2002 Tsai ..... 190/18 A
6,405,407 B1 * 6/2002 Chen ..... 16/113.1
6,470,529 B1 * 10/2002 Chang ..... 16/113.1
6,508,344 B1 * 1/2003 Lu ..... 190/115

* cited by examiner

*Primary Examiner*—Anthony Knight
*Assistant Examiner*—Lisa Bannapradist
(74) *Attorney, Agent, or Firm*—Charles E. Baxley

(57) ABSTRACT

A retractable handle device includes a pair of conduits, a pair of tubes slidably engaged in the conduits, a housing secured on top of the tubes, and a hand grip rotatably secured to the housing with a shaft. One or more spring biased latches are disposed in the tubes, a bar is slidably received in the housing and coupled to the spring biased latches with links for selectively actuating the spring biased latches to lock the conduits and the tubes. A pin is slidably received in the shaft. A knob is slidably received in the hand grip for selectively actuating the pin.

8 Claims, 10 Drawing Sheets

RETRACTABLE HANDLE ASSEMBLY HAVING ROTATABLE HAND GRIP

BACKGROUND OF THE INVENTION

1. Field of the Invention

The present invention relates to a retractable handle assembly, and more particularly to a retractable handle assembly for suitcases and having a rotatable hand grip rotatably provided thereon.

2. Description of the Prior Art

Typical retractable handle assemblies are provided for attaching to such as the suitcases and comprise two or more pairs tubes or pipes slidably engaged with each other and extendible outward relative to each other for allowing the tubes or pipes to be adjusted and pulled outward of the suitcases for carrying purposes, and to be stored in the suitcases. A hand grip is normally solidly secured on top of the tubes or pipes and may not be rotated relative to the tubes or pipes or the suitcases. U.S. Pat. No. 5,351,984 to Cheng discloses one of the typical retractable handle assemblies and also includes a hand grip solidly secured on top of the tubes or pipes. When the suitcases carry heavy goods therein and when the suitcases are tilted or are falling down, the hand grip may not be rotated relative to the suitcases such that the users hands holding the hand grips may be twisted and hurt by the hand grip when the heavy suitcases falling down.

The present invention has arisen to mitigate and/or obviate the afore-described disadvantages of the conventional retractable handle assemblies.

SUMMARY OF THE INVENTION

The primary objective of the present invention is to provide a retractable handle assembly including a rotatable hand grip rotatably provided thereon for allowing the hand grip to be rotated relative to the suitcase and for preventing the users hands from being rotated and twisted and hurt by the hand grip when the suitcases are falling down.

In accordance with one aspect of the invention, there is provided a retractable handle assembly comprising a pair of conduits, a pair of tubes slidably engaged in the conduits, and movable into the conduits in a storing position, and extendible outward of the conduits in an outward extended and working position, a housing secured on top of the tubes and moved in concert with the tubes relative to the conduits, a hand grip rotatably secured to the housing, and means for selectively locking the tubes to the conduits.

The housing includes a shaft secured thereon, the hand grip is rotatably secured onto the shaft. The hand grip includes an orifice formed therein for rotatably receiving the shaft, the shaft includes an enlarged head laterally extended outward therefrom and engaged with the hand grip for preventing the hand grip from being disengaged from the shaft.

The selectively locking means includes at least one spring biased latch provided in a first of the tubes, a bar slidably received in the housing, and a link coupling the bar to the spring biased latch for selectively actuating the spring biased latch to engage with the conduits.

A spring biasing device may further be provided for biasing the bar away from the tubes and the conduits.

The selectively locking means includes a pin slidably engaged through the shaft, and preferably coupled to the bar and moved in concert with the bar.

The selectively locking means includes means for depressing the pin inward of the shaft and includes a knob slidably engaged in the hand grip, a beam and a lever are pivotally secured to the hand grip and each includes a first end and a second end, the first end of the beam is pivotally secured to the knob, a block is pivotally secured to the second ends of the beam and the lever, the first end of the lever includes an actuator aligned with the pin for depressing the pin inward of the shaft when the knob is depressed inward of the hand grip.

A spring biasing device may further be provided for biasing the knob outward of the hand grip.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
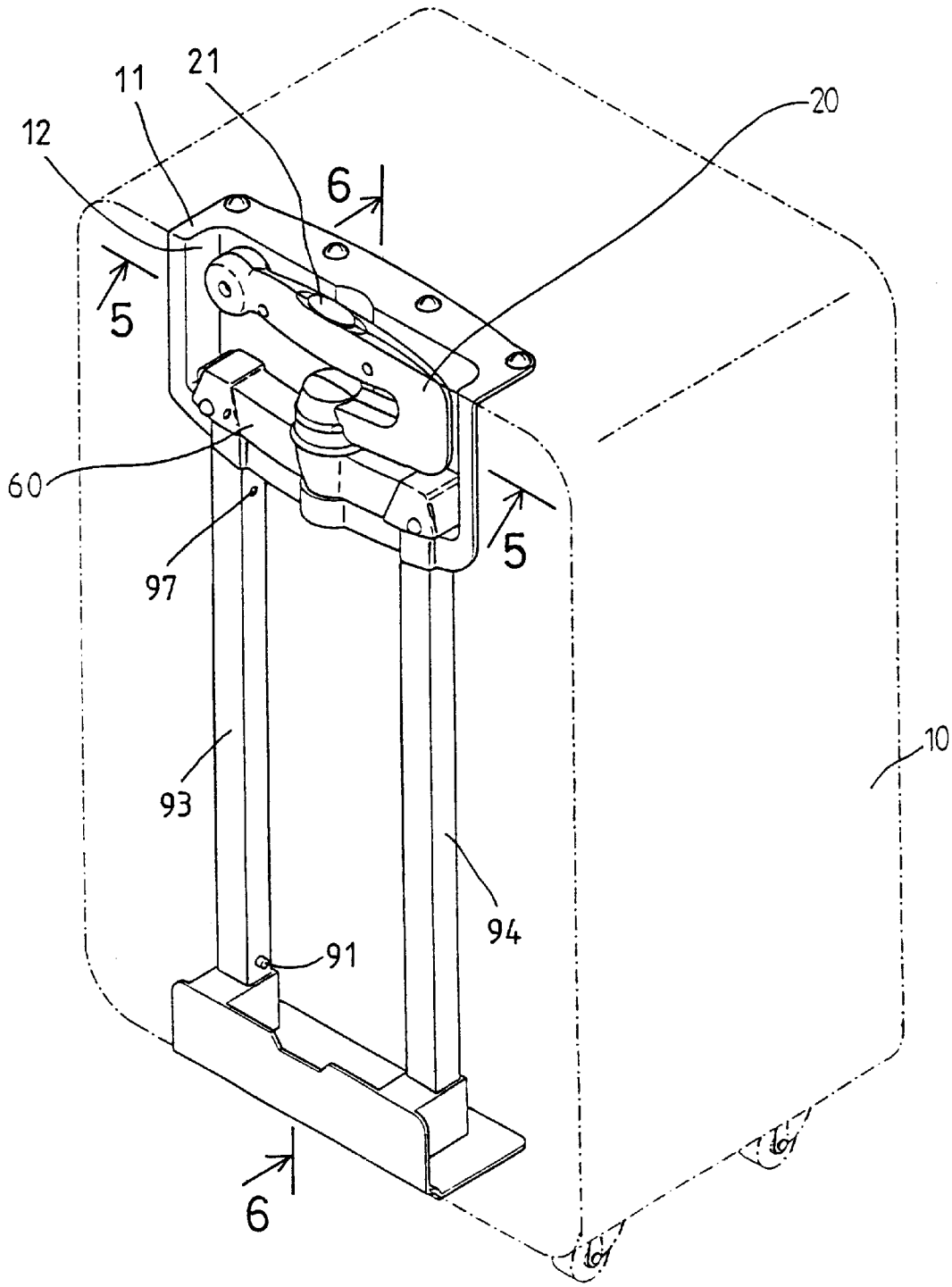
FIG. 1 is a perspective view of a retractable handle assembly in accordance with the present invention for attaching onto a suitcase.
Figure 3:
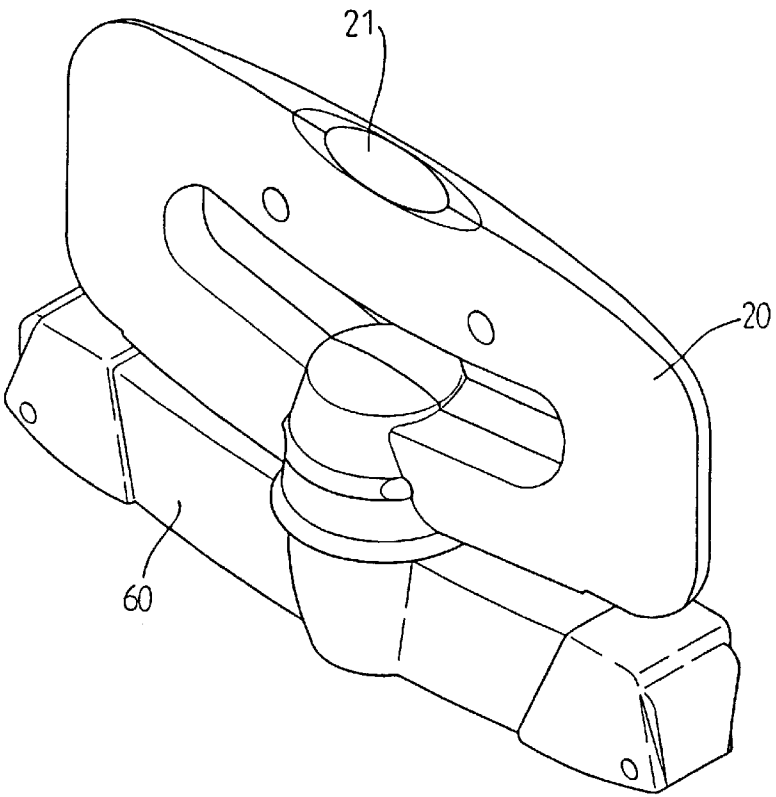
FIG. 3 is a perspective view similar to FIG. 2, illustrating the other embodiment of the rotatable hand grip of the retractable handle assembly.
Figure 2:
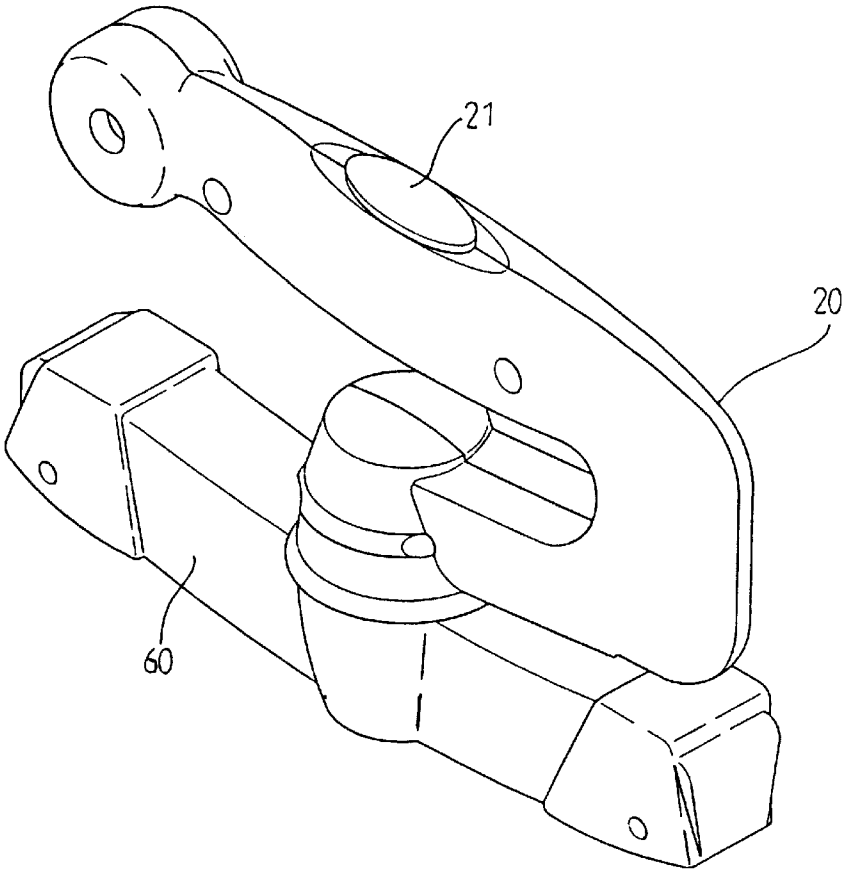
FIG. 2 is a perspective view illustrating a rotatable hand grip of the retractable handle assembly.
Figure 4:
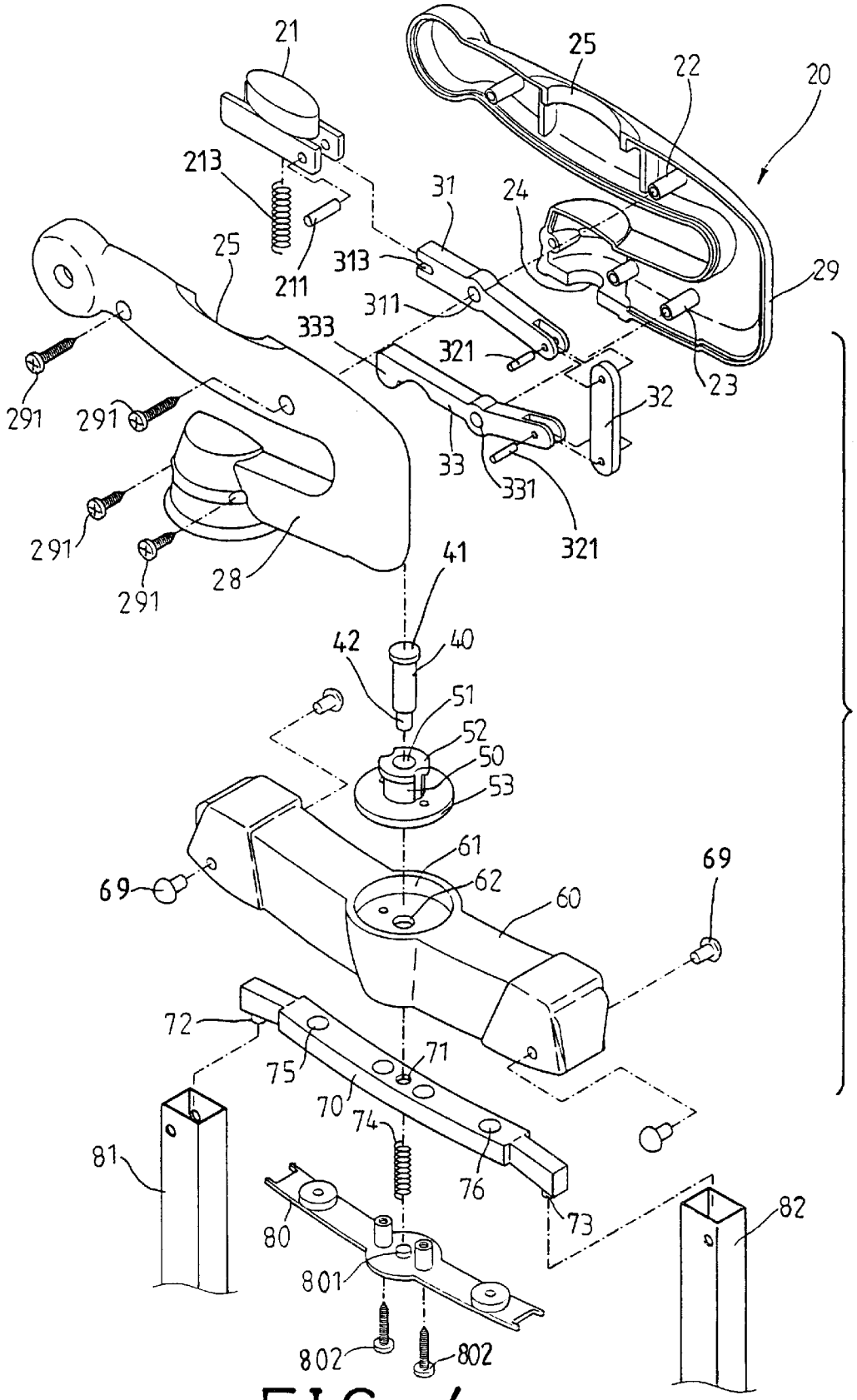
FIG. 4 is a partial exploded view of the retractable handle assembly.
Figure 5:
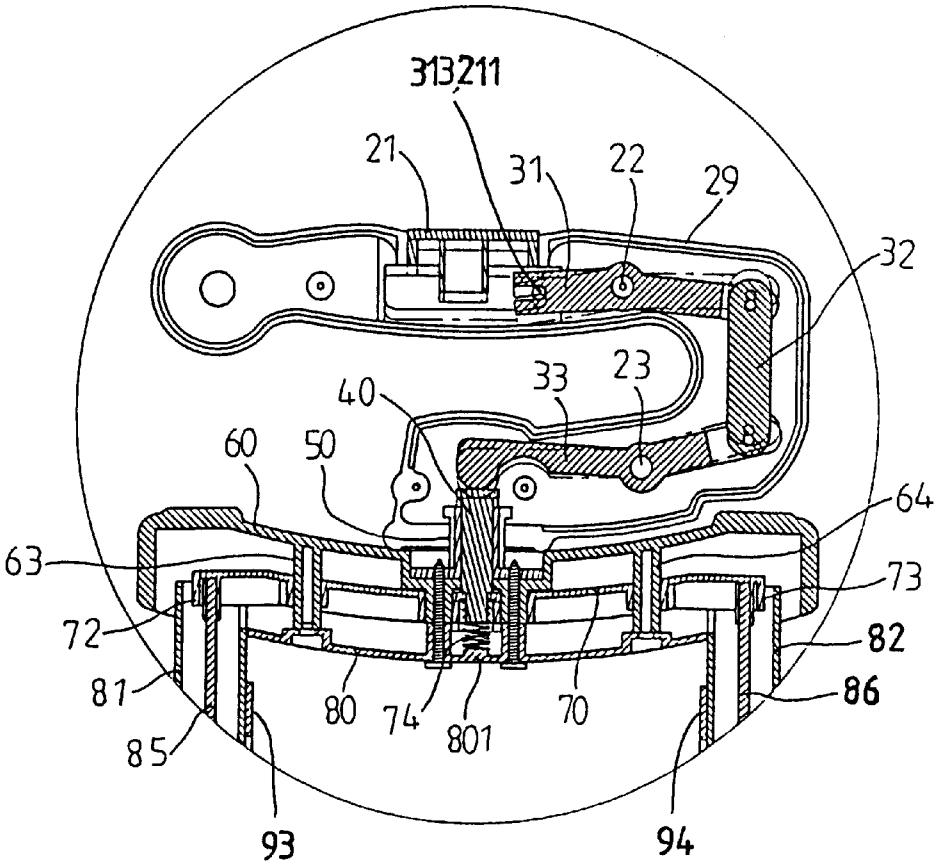
FIG. 5 is an enlarged partial cross sectional view taken along lines 5—5 of FIG. 1.
Figure 6:
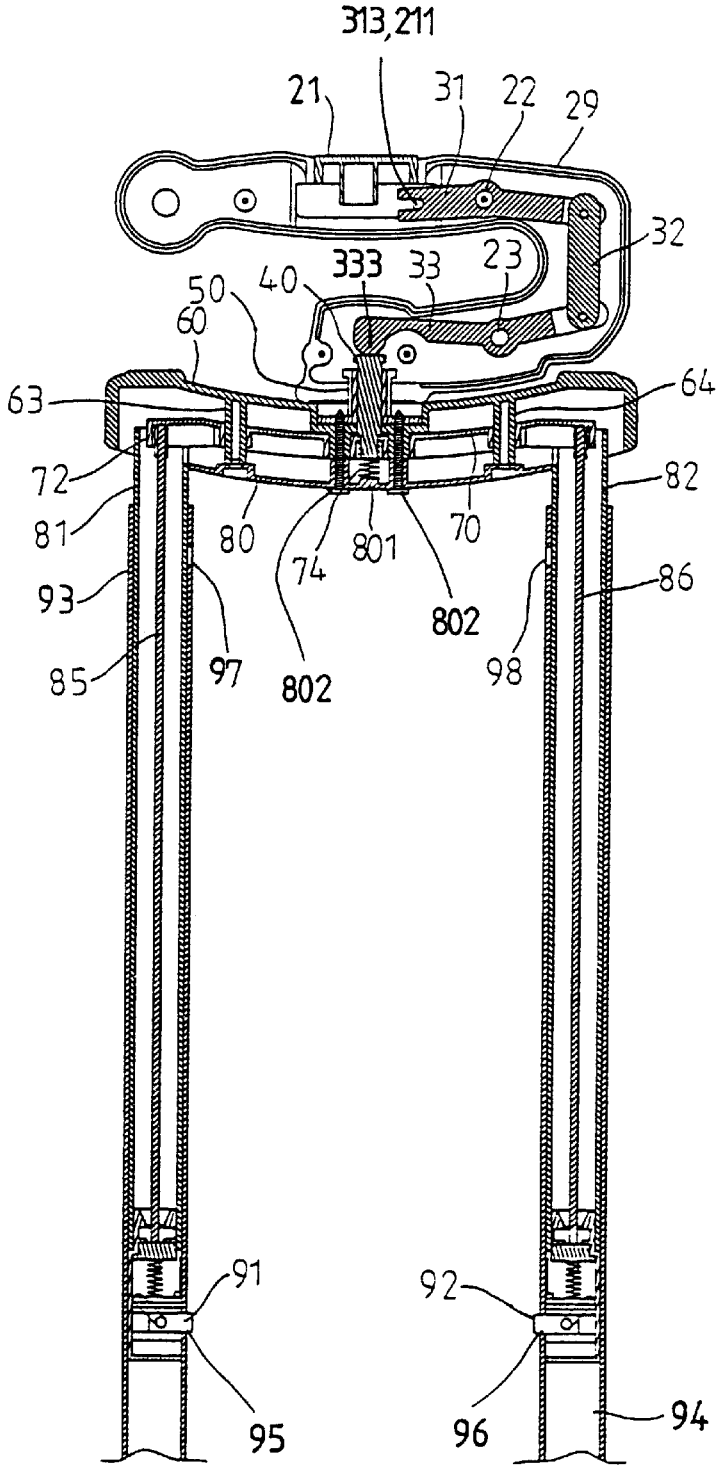
FIG. 6 is a partial cross sectional view taken along lines 6—6 of FIG. 1.

Referring to the drawings, and initially to FIGS. 1–6, a retractable handle assembly in accordance with the present invention is provided for attaching onto an object, such as a suitcase 10, and particularly for attaching onto the rear portion of the suitcase 10 for carrying the suitcase 10. A bracket 11 is secured in the upper and rear portion of the suitcase 10, and includes a depression 12 formed therein for receiving a rotatable hand grip 20. Two conduits 93, 94 are secured on the outer portion of the back of the suitcase 10, or may be secured within the suitcase 10, and each includes an orifice 95, 96 formed in the lower portion thereof (FIG. 6) and each includes an aperture 97, 98 formed in the upper portion thereof.

Two tubes 81, 82 are slidably received in the conduits 93, 94 respectively. A housing 60 includes two ends secured on top of the tubes 81, 82 with fasteners 69 and moved in concert with the tubes 81, 82 relative to the conduits 93, 94, and includes a recess 61 and an orifice 62 formed in the upper portion thereof. The housing 60 includes one or more rods 63, 64 extended therein (FIGS. 5–9). A bar 70 includes one or more holes 75, 76 formed therein for slidably receiving the rods 63, 64 and for allowing the bar 70 to be slidably received and retained in the housing 60. A cap 80 is secured to the bottom of the housing 60 with such as the fasteners 802 for preventing the bar 70 from being disengaged from the housing 60.

The bar 70 includes two ends each having a coupler 72, 73 provided thereon or extended therefrom, and secured to two links 85, 86 respectively. The links 85, 86 each includes a lower end having a typical spring biased catch 91, 92 provided therein for selectively engaging with the orifices 95, 96 of the conduits 93, 94 (FIG. 6), and for locking and retaining the links 85, 86 in the conduits 93, 94 respectively when the tubes 81, 82 are engaged and received within the conduits 93, 94. The typical spring biased catch 91, 92 may also be used for selectively engaging with the apertures 97, 98 of the conduits 93, 94 (FIG. 9), and for locking and retaining the links 85, 86 in the conduits 93, 94 respectively when the tubes 81, 82 are extended outward of the conduits 93, 94.

A shaft 50 includes a disc 53 extended from the lower portion thereof and snugly received in the recess 61 of the housing 60 with such as a force-fitted engagement, and includes an enlarged head 52 extended radially outward from the upper portion thereof, and includes a bore 51 formed therein. A pin 40 is slidably engaged through the bore 51 of the shaft 50 and includes an enlarged upper head 41 for engaging with the shaft 50 and for limiting the sliding of the pin 40 relative to the shaft 50, and for preventing the pin 40 from being engaged through the bore 51 of the shaft 50. The pin 40 includes a lower end extended through the orifice 62 of the housing 60, and includes a stud 42 of a reduced diameter engaged through a hole 71 of the bar 70.

A spring 74 is engaged between a projection 801 of the cap 80 and engaged with the stud 42 and engaged with the bar 70 for biasing the bar 70 upward away from the tubes 81, 82 and the conduits 93, 94 and for biasing the pin 40 upward beyond the shaft 50. The pin 40 is engaged with the bar 70 for moving the bar 70 and thus the links 85, 86 downward against the spring 74. The fasteners 802 may engage through the cap 80 and the housing 60 and may engage with the disc 53 for solidly securing the cap 80 and the housing 60 and the disc 53 of the shaft 50 together.

The rotatable hand grip 20 includes such as two half members 28, 29 secured together with fasteners 291, and may be formed into an open-shape (FIG. 2), or an enclosed shape (FIG. 3), and includes an orifice 24 formed in the lower and middle portion thereof for rotatably receiving the shaft 50 and for allowing the hand grip 20 to be rotatably secured onto the housing 60 with the shaft 50. The head 52 of the shaft 50 may engage with the hand grip 20 for preventing the hand grip 20 from being disengaged from the shaft 50. The hand grip 20 includes an upper peg 22 and a lower peg 23 provided therein, and includes an opening 25 formed in the upper portion thereof.

A beam 31 includes a hole 311 formed in the middle portion thereof for rotatably receiving the upper peg 22 and for rotatably securing the beam 31 to the upper peg 22 of the hand grip 20. A lever 33 includes a hole 331 formed in the middle portion thereof for rotatably receiving the lower peg 23 and for rotatably securing the beam 31 to the lower peg 23 of the hand grip 20. A block 32 has two ends pivotally or rotatably secured to one ends of the beam 31 and the lever 33 with pivot axles 321. A knob 21 is slidably engaged through the opening 25 of the hand grip 20. A post 211 is secured in the knob 21. The beam 31 includes a channel 313 formed in the other end thereof for slidably receiving the post 211 and for pivotally or rotatably securing the other end of the beam 31 to the knob 21.

The other end of the lever 33 includes an actuator 333 provided thereon for engaging with the pin 40 and for depressing the pin 40 and the bar 70 downward against the spring 74. A spring 213 may be provided for engaging with the knob 21 and for biasing the knob 21 upward and outward through the opening 25 of the hand grip 20. The knob 21 may thus be depressed inward of the hand grip 20 against the spring 213. It is to be noted that the hand grip 20 is rotatably secured to the housing 60 with the shaft 50. The pin 40 is received in the center of the shaft 50, such that the depression or actuation of the pin 40 will not affect the rotational attachment of the hand grip 20 onto or relative to the housing 60.

Figure 7:
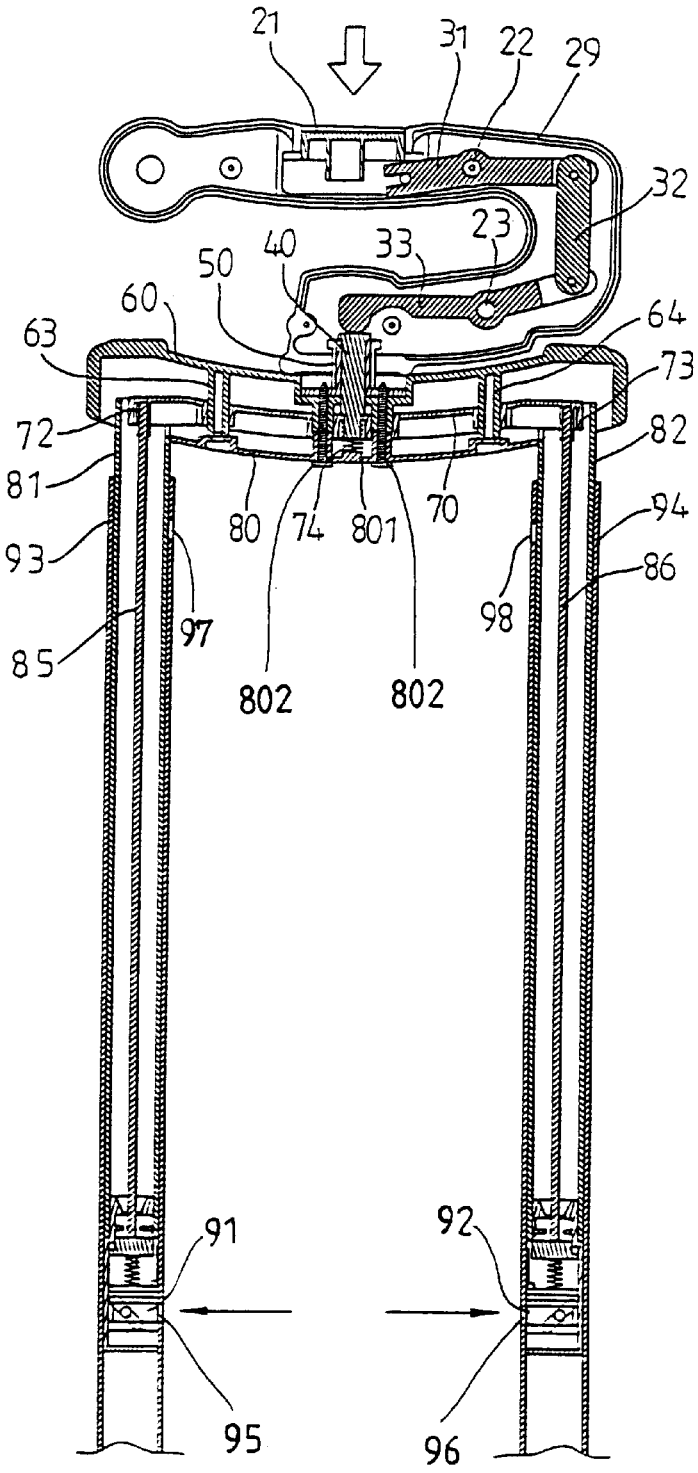
FIGS. 7, 8, 9 are partial cross sectional views similar to FIG. 6, illustrating the operation of the retractable handle assembly.
Figure 8:
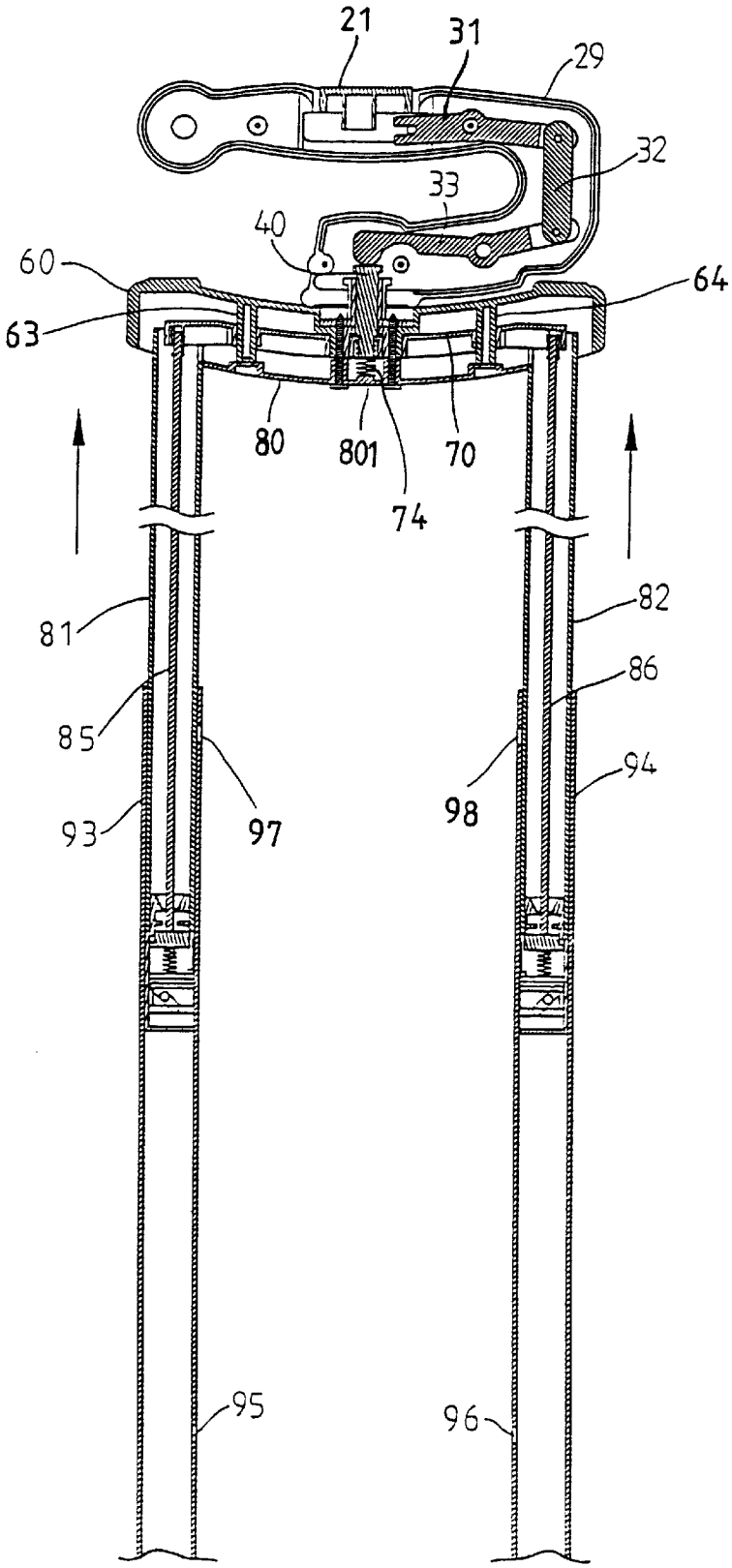
Figure 9:
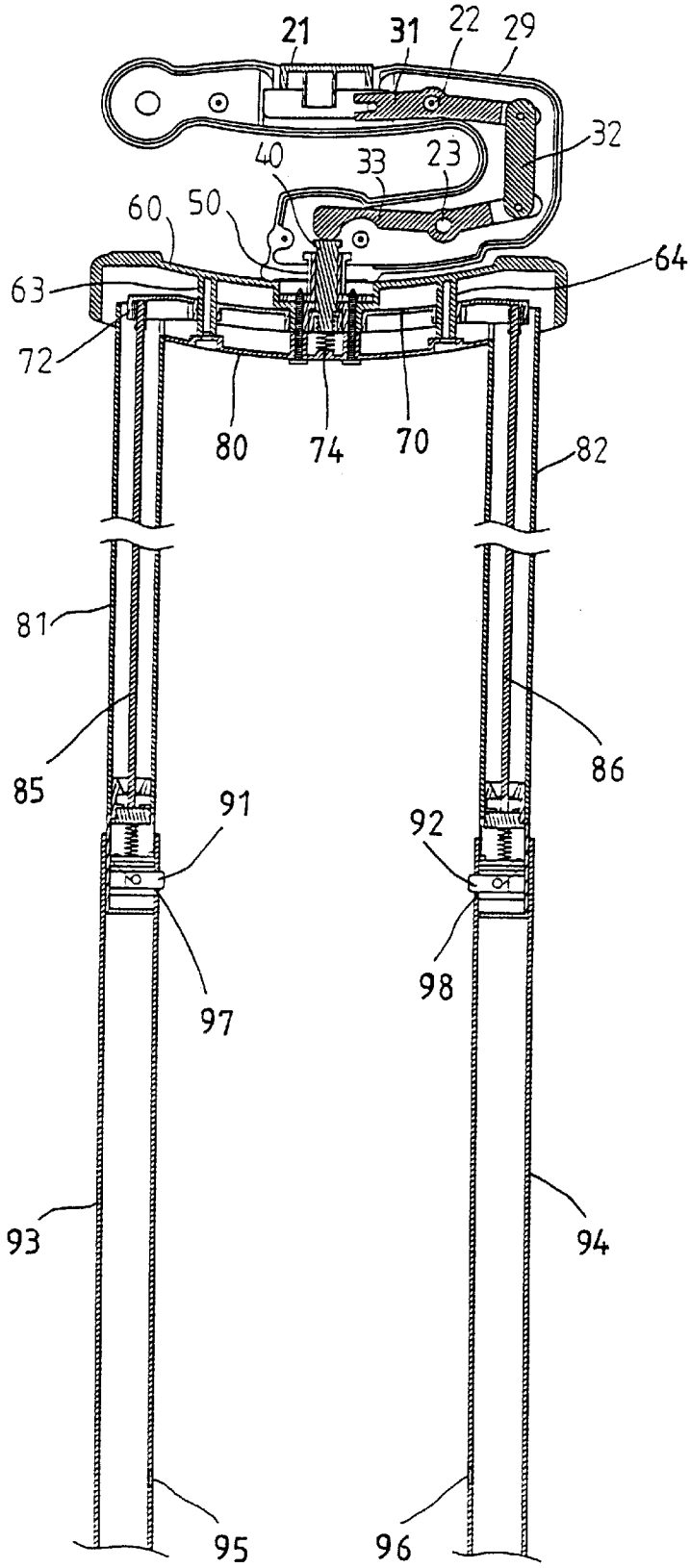

In operation, as shown in FIG. 7, when the knob 21 is depressed inward of the hand grip 20 against the spring 213, the actuator 333 of the lever 33 may be caused to depress the pin 40 and thus the bar 70 downward against the spring 74, the links 85, 86 may thus be forced and pushed by the bar 70 to disengage the spring biased catch 91, 92 from the orifices 95, 96 of the conduits 93, 94, for allowing the tubes 81, 82 to be moved outward of the conduits 93, 94 (FIGS. 8, 9). When the knob 21 is released, the spring 74 may bias the bar 70 away from the tubes 81, 82, and the spring biased catch 91, 92 may be aligned with and biased to engage with the apertures 97, 98 of the conduits 93, 94 (FIG. 9), for locking the tubes 81, 82 to the conduits 93, 94 at the outward extended position.

Figure 10:
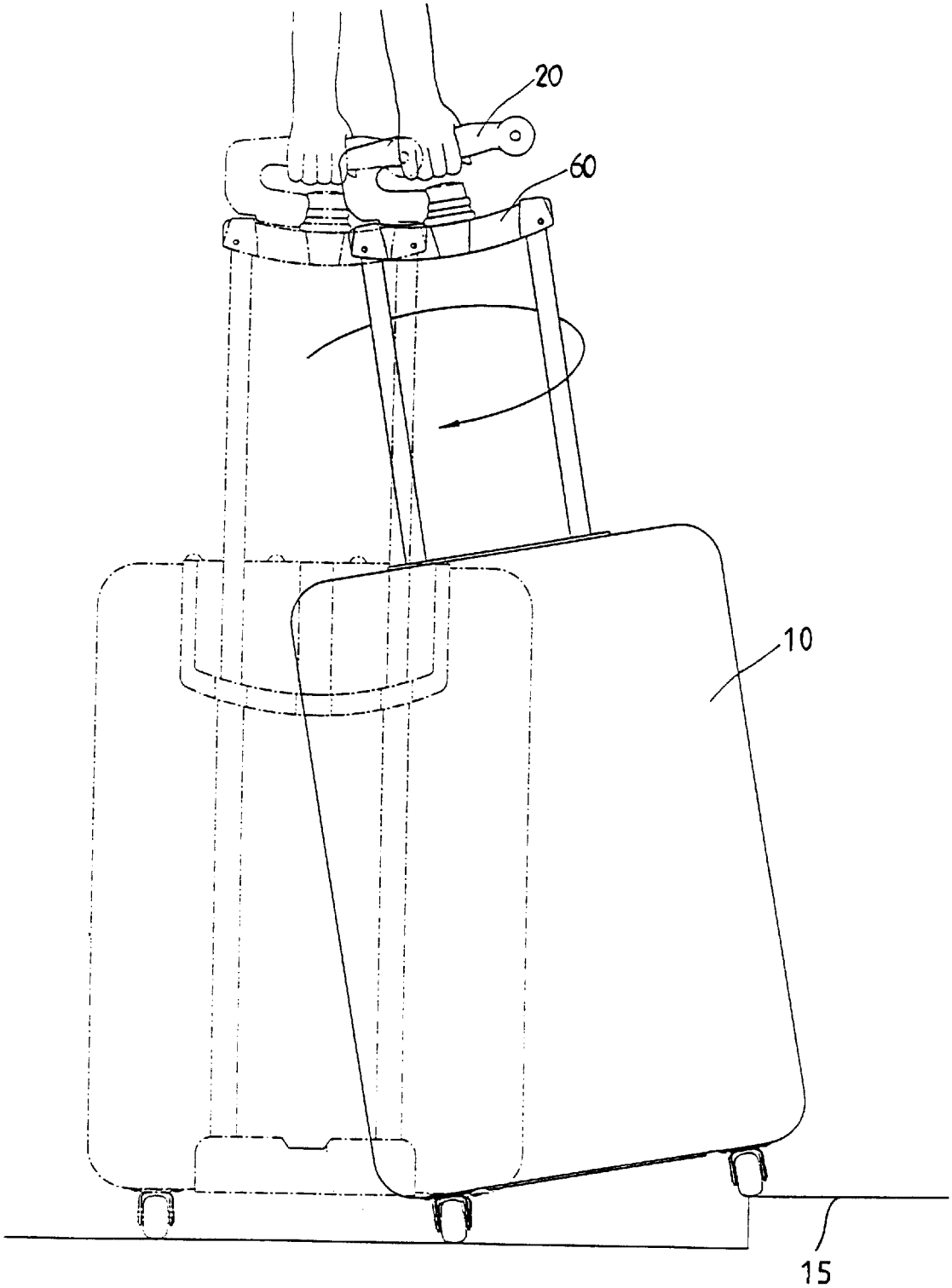
FIGS. 10 and 11 are plan schematic views illustrating the operation of the retractable handle assembly.
Figure 11:
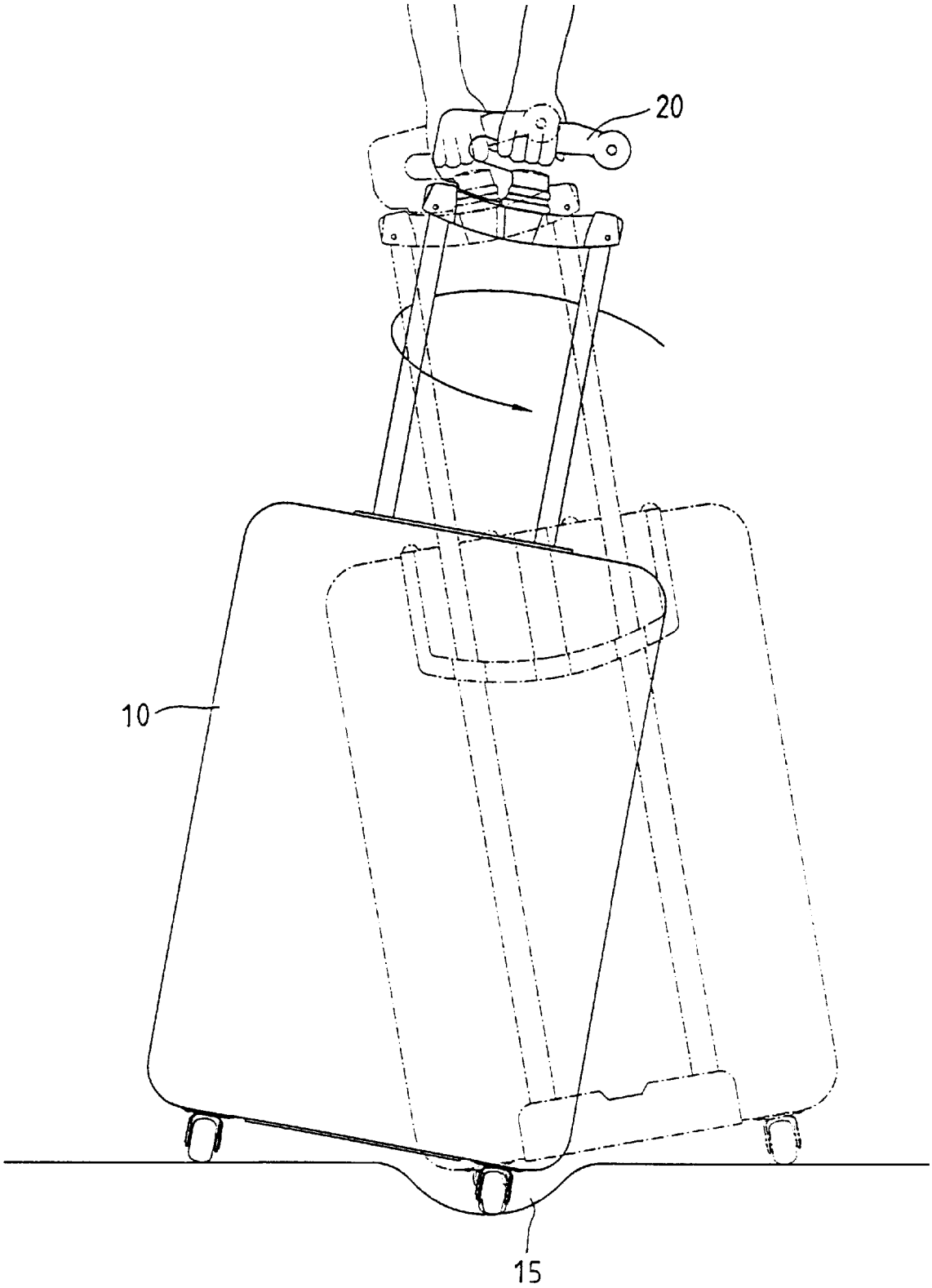

As shown in FIGS. 10, 11, when the suitcase 10 is moved across an uneven ground 15, and then the suitcase 10 is tilted or is falling down, the hand grip 20 will not be rotated and twisted together with the suitcase 10, due to the rotatable engagement of the hand grip 20 to the housing 60 with the shaft 50. The hands of the users that hold the hand grip 20 thus will not be twisted and hurt by the hand grip 20 when the suitcase 10 is falling down.

Accordingly, the retractable handle assembly in accordance with the present invention includes a rotatable hand grip rotatably provided thereon for allowing the hand grip to be rotated relative to the suitcase and for preventing the users hands from being rotated and twisted and hurt by the hand grip when the suitcases are falling down.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retractable handle assembly comprising:

a pair of conduits, a pair of tubes slidably engaged in said conduits, and moveable into said conduits in a storing position, and extendible outward of said conduits in an outward extending working position, a housing secured on top of said tubes and moved in concert with said tubes relative to said conduits, a hand grip rotatably secured to said housing, and means for selectively locking said tubes to said conduits, wherein said hand grip is rotatable secured to said housing with a shaft, said selectively locking means includes a pin slidably engaged through said shaft, also wherein said selectively locking means includes means for depressing said pin inward of said shaft, and further wherein said depressing means includes a knob slidably engaged in said hand grip, a beam and a lever are pivotally secured to said hand grip and each includes a first end and a second end, said first end of said beam is pivotally secured to said knob, a block is pivotally secured to said second ends of said beam and said lever, said first end of said lever includes an actuator aligned with said pin for depressing said pin inward of said shaft when said knob is depressed inward of said hand grip.

2. The retractable handle assembly according to claim 1, wherein said housing includes a shaft secured thereon, said hand grip is rotatably secured onto said shaft.

3. The retractable handle assembly according to claim 2, wherein said hand grip includes an orifice formed therein for rotatably receiving said shaft, said shaft includes an enlarged head laterally extended outward therefrom and engaged with said hand grip for preventing said hand grip from being disengaged from said shaft.

4. The retractable handle assembly according to claim 1, wherein said selectively locking means includes at least one spring biased latch provided in a first of said tubes, a bar slidably received in said housing, and a link coupling said bar to said at least one spring biased latch for selectively actuating said at least one spring biased latch to engage with said conduits.

5. The retractable handle assembly according to claim 4 further comprising means for biasing said bar away from said tubes and said conduits.

6. The retractable handle assembly according to claim 1, wherein said selectively locking means includes at least one spring biased latch provided in a first of said tubes, a bar slidably received in said housing, and a link coupling said bar to said at least one spring biased latch for selectively actuating said at least one spring biased latch to engage with said conduits, said pin is coupled to said bar and moved in concert with said bar.

7. The retractable handle assembly according to claim 6 further comprising means for biasing said bar away from said tubes and said conduits.

8. The retractable handle assembly according to claim 1 further comprising means for biasing said knob outward of said hand grip.

* * * * *